US010704199B2

(12) United States Patent
Henaff et al.

(10) Patent No.: US 10,704,199 B2
(45) Date of Patent: Jul. 7, 2020

(54) USE OF CELLULOSIC FIBRE PULP

(71) Applicant: Smurfit Kappa Paper Holdings France, Paris (FR)

(72) Inventors: Jean Henaff, Talence (FR); Ronald Bredemo, Pitea (SE)

(73) Assignee: SMURFIT KAPPA PAPER HOLDINGS FRANCE, Paris (FR)

( * ) Notice: Subject to any disclaimer, the term of this patent is extended or adjusted under 35 U.S.C. 154(b) by 57 days.

(21) Appl. No.: 15/760,036

(22) PCT Filed: Sep. 13, 2016

(86) PCT No.: PCT/EP2016/071564
§ 371 (c)(1),
(2) Date: Mar. 14, 2018

(87) PCT Pub. No.: WO2017/046086
PCT Pub. Date: Mar. 23, 2017

(65) Prior Publication Data

US 2018/0266054 A1 Sep. 20, 2018

(30) Foreign Application Priority Data

Sep. 15, 2015 (EP) ..... 15185250

(51) Int. Cl.

| | |
|---|---|
| ***D21H 11/14*** | (2006.01) |
| ***D21H 27/10*** | (2006.01) |
| ***D21H 11/00*** | (2006.01) |
| ***D21H 11/04*** | (2006.01) |

(52) U.S. Cl.
CPC ..... *D21H 11/14* (2013.01); *D21H 11/00* (2013.01); *D21H 11/04* (2013.01); *D21H 27/10* (2013.01)

(58) Field of Classification Search
USPC ..... 162/181.2
See application file for complete search history.

(56) References Cited

U.S. PATENT DOCUMENTS

| | | | |
|---|---|---|---|
| 4,145,246 | A | 3/1979 | Goheen et al. |
| 4,191,610 | A | 3/1980 | Prior |
| 4,295,926 | A | 10/1981 | Bentvelzen et al. |
| 5,836,525 | A | 11/1998 | Garnier et al. |
| 8,231,764 | B2 | 7/2012 | Husband et al. |
| 2003/0051837 | A1 | 3/2003 | Silenius |
| 2004/0168781 | A1 | 9/2004 | Silenius |
| 2005/0123734 | A1 | 6/2005 | Altheimer |
| 2012/0018110 | A1 | 1/2012 | Jiang |
| 2014/0137880 | A1 | 5/2014 | Zitturi et al. |

FOREIGN PATENT DOCUMENTS

| | | | |
|---|---|---|---|
| CN | 102828437 | A | 12/2012 |
| JP | 2991251 | B2 | 12/1999 |
| JP | 3067332 | B2 | 7/2000 |
| JP | 2005226214 | A | 8/2005 |
| JP | 2012149355 | A | 8/2012 |
| WO | WO 2010/149711 | A2 | 12/2010 |
| WO | WO 2011/055148 | A1 | 5/2011 |

OTHER PUBLICATIONS

Pettersson et al., "Strong and bulky paperboard sheets from surface modified CTMP, manufactured at low energy", Nordic Pulp & Paper Research Journal, 2015, 30(2): 319-325.
Sakaemura et al., "Strength Properties of Wet-Combination Paper", Japan Tappi Journal, 2013, 67(8): 68-74.
Freeness Conversion Table, Canadian Std Freeness—Schopper-Riegler number, 2019.
Svensk Standard, SS-ISO 9895:2009, "Paper and board—Compressive strength—Short-span test", 2009.
"Paperboard", Wikipedia, http://en.wikipedia.org/wiki/Paperboard, downloaded on Jul. 30, 2019.
Aaltio, "The Effect of Highly Beaten Birch Pulp Fraction on the Properties of Kraft Paper", Erikoisnumero 4 a, 1962, Paperi ja Puu, pp. 217-222.
Clark, "Pulp Technology and Treatment for Paper", Second Edition, 1985, pp. 779-781.
Fellers, "Mass Characterization, the mechanical properties", Scan Forsk, Report No. 206, 1979, pp. 62-86.
Fellers, "The Significance of Structure for the Compression Behavior of Paperboard", International Fiber Science and Technology Series/8, Paper Structure and Properties, 1986, pp. 293-310.
Htun et al., "The invariant mechanical properties of oriented handsheets", Tappi, 1982, 65(4): 113-117.
Nordström, "Effects of pulp type and headbox design on antisotropy and other sheet properties in twin-wire roll forming", Nordic Pulp and Paper Research Journal, 2003, 18(3): 288-295.
Nordström, "Two-stage versus one-stage refining of unbleached softwood kraft pulp—effects on tensile properties and compression strength", Paper Physics, Nordic Pulp & Paper Research Journal, 2015, 30(3): 461-465.
"Paper Vocabulary, item 1618", SIS, General Standards Division (SIS-STG), Technical Committee TK 24, Pulp and Paper, Jan. 1992, pp. 8-10, 138.

*Primary Examiner* — Mark Halpern
(74) *Attorney, Agent, or Firm* — James S. Keddie; Bozicevic, Field & Francis LLP

(57) ABSTRACT

Use of cellulosic fibre pulp having a Schopper-Riegler number according to ISO 5267-1 of about 70 or more as an additive to papermaking pulp for enhancing compressive strength of paper or board manufactured from the papermaking pulp. A process for enhancing compressive strength of paper or board manufactured from a papermaking pulp, comprising use of a cellulosic fibre pulp having a Schopper-Riegler number according to ISO 5267-1 of about 70 or more as a component of the papermaking pulp.

3 Claims, No Drawings

USE OF CELLULOSIC FIBRE PULP

CROSS REFERENCE TO RELATED APPLICATIONS

The present application is the National Stage under 35 U.S.C. § 371 of PCT International Application No. PCT/EP2016/071564, filed Sep. 13, 2016, which claims the benefit of and priority to European Application No. 15185250.6, filed Sep. 15, 2015, which applications are incorporated herein by reference in their entirety.

TECHNICAL FIELD

The present application relates to use of cellulosic fibre pulp having a Schopper-Riegler number according to ISO 5267-1 of about 70 or more as a component of a papermaking pulp, and to a process for enhancing compressive strength of paper or board manufactured from a papermaking pulp.

BACKGROUND ART

Papermaking pulp, i.e. pulp intended for the manufacture of paper or board, is produced by separating the fibres of a cellulosic material, such as wood, by chemical and/or mechanical means. As a common example, kraft pulp is produced by cooking of wood chips according to the sulphate process. Papermaking pulp may also comprise or consist of recycled fibre, i.e. a fibre material which has previously been incorporated in a paper or board product.

Paper or board is employed as a packaging material either in the form of a single ply product or, often, after conversion into a multi ply product, such as a multi ply paperboard or a corrugated fibreboard. It is required that a box formed from such a packaging material protects its content and withstands buckling, fold and/or collapse under the load of other boxes or goods stacked on top of it.

US 2004/0168781 discloses a paper pulp and a method of making paper pulp. The paper pulp includes at least one of cellulose fibre and mechanical pulp fibre, filler, and noil produced from refined cellulose fibre in a range of 0.1 to 15% by weight of the paper pulp. The noil may be produced by refining cellulose fibre to a Schopper-Riegler number greater than 80.

U.S. Pat. No. 8,231,764 discloses a method of preparing a composition for use as a filler in paper or as a paper coating, comprising a step of microfibrillating a fibrous substrate comprising cellulose in the presence of an inorganic particulate material.

There is a desire in the field to improve the properties of paper or board based packaging materials in respect of maintaining the shape of a box formed from such packing materials and/or of maintaining the condition of goods inside the box, e.g. when the box is under load of other boxes or goods stacked on top of it.

SUMMARY OF THE INVENTION

It is an object of the present invention to endow paper or board manufactured from a papermaking pulp with improved properties in respect of maintaining the shape of a box formed from packing materials based on such paper or board. It is another object of the present invention to obtain an enhanced compressive strength of paper or board manufactured from a papermaking pulp with no or reduced need for conventional strength agents. As is reflected by the appended claims, the invention is based on the utilisation of the capacity of papermaking pulp, comprising a highly refined cellulosic fibre pulp, to provide hitherto unidentified strength properties to paper or board manufactured from the papermaking pulp.

These objects as well as other objects of the invention, which should be apparent to a person skilled in the art after having studied the description below, are thus accomplished by use of cellulosic fibre pulp having a Schopper-Riegler number according to ISO 5267-1 of about 70 or more as a component of a papermaking pulp for enhancing compressive strength of paper or board manufactured from the papermaking pulp. Said objects are also accomplished by the process of the appended claims.

The cellulosic fibre pulp comprises separated fibres of a cellulosic material. The cellulosic fibre pulp may typically be or comprise a woodpulp, i.e. a pulp that is obtained from wood, such as a softwood and/or hardwood pulp, i.e. a pulp that is manufactured from softwood and/or hardwood. The cellulosic fibre pulp may be or comprise a mechanical and/or chemical pulp, i.e. a pulp in which the fibres have been separated by mechanical and/or chemical means. Thus, the cellulosic fibre pulp may also be or comprise a chemimechanical pulp. The cellulosic fibre pulp may typically be or comprise a kraft pulp or a sulphate pulp, i.e. a pulp that is manufactured by cooking a cellulosic material with a solution comprising sodium hydroxide and sodium hydrogen sulphide as active components, such as a softwood and/or hardwood kraft pulp, or a bisulphite pulp, i.e. a pulp that is manufactured by cooking wood with a solution having a pH value of approximately 4 and containing hydrogen sulphite (bisulphite) ions. The cellulosic fibre pulp may also be or comprise a recycled fibre pulp, i.e. a pulp that is obtained from a fibre material which has previously been incorporated in a paper or board product. It is preferred that the recycled fibre pulp is obtained from, e.g., old corrugated containers or from clippings from corrugated box manufacturing, such as from material of EN 643, European List of Standard Grades of Paper and Board for Recycling, grades 1.02, 1.05 or 4.01. The cellulosic fibre pulp may be bleached or unbleached. It is preferred that the cellulosic fibre pulp is an unbleached softwood kraft pulp or a bleached hardwood kraft pulp.

By microfibrillating of cellulose is meant a process in which microfibrils of cellulose are liberated or partially liberated as individual species or as smaller aggregates as compared to the fibres of a pre-microfibrillated pulp. Typical cellulose fibres (i.e., pre-microfibrillated pulp) suitable for use in papermaking, such as the "cellulosic fibre pulp" referred to herein, include larger aggregates of hundreds or thousands of individual cellulose microfibrils. Microfibrillated cellulose, MFC, is also called nanofibrillated cellulose, NFC, cellulose nanofibrils, CNF, or simply nanocellulose. Microfibrillated cellulose is a nanoscaled material composed of fibrils that are around 10-20 nm wide and up to several micrometres in length. The term "cellulosic fibre pulp" does, as used herein, not refer to microfibrillated cellulose. The cellulosic fibre pulp referred to herein is thus not microfibrillated cellulose. The diminutive particles, individual microfibrils or smaller aggregates of microfibrils, of such cellulose products are not regarded as and do not behave like fibres.

Particle size properties of microfibrillated cellulose materials may be measured by the well-known conventional method employed in the art of laser diffraction, using a Malvern Mastersizer S machine as supplied by Malvern Instruments Ltd (or by other methods giving essentially the same result). In the laser diffraction technique, the size of particles in powders, suspensions and emulsions may be measured using the diffraction of a laser beam, based on an application of Mie theory. Such a machine provides measurements and a plot of the cumulative percentage by volume of particles having a size, referred to in the art as the "equivalent spherical diameter" (e.s.d), less than given e.s.d values. The mean particle size $d_{50}$ is the value determined in this way of the particle e.s.d at which there are 50% by volume of the particles which have an equivalent spherical diameter less than that $d_{50}$ value. The cellulosic fibre pulp may have a $d_{50}$ of more than about 525 μm, preferably of more than about 600 μm.

The Schopper-Riegler number is a measure of the drainability of a pulp suspension in water and is determined according to a standardised test procedure, i.e. ISO 5267-1. The drainability constitutes a useful index of the amount of mechanical treatment to which the pulp has been subjected. The cellulosic fibre pulp having a Schopper-Riegler number of about 70 or more is accordingly an indication of that the pulp has been subjected to extensive mechanical treatment, i.e. that the pulp is highly beaten or refined. Thus, the cellulosic fibre pulp may have obtained its Schopper-Riegler number of about 70 or more by beating or refining of the fibres subsequent to a process in which the fibres of a cellulosic material have been separated by mechanical, chemical and/or chemimechanical means.

The bulk of the papermaking pulp comprises separated fibres of a cellulosic material. The bulk of the papermaking pulp may typically be or comprise a woodpulp, i.e. a pulp that is obtained from wood, such as a softwood and/or hardwood pulp, i.e. a pulp that is manufactured from softwood and/or hardwood. The bulk of the papermaking pulp may be or comprise a mechanical and/or chemical pulp, i.e. a pulp in which the fibres have been separated by mechanical and/or chemical means. Thus, the bulk of the papermaking pulp may also be or comprise a chemimechanical pulp. The bulk of the papermaking pulp may typically be or comprise a kraft pulp or a sulphate pulp, i.e. a pulp that is manufactured by cooking a cellulosic material with a solution comprising sodium hydroxide and sodium hydrogen sulphide as active components, such as a softwood and/or hardwood kraft pulp, or a bisulphite pulp, i.e. a pulp that is manufactured by cooking wood with a solution having a pH value of approximately 4 and containing hydrogen sulphite (bisulphite) ions. The bulk of the papermaking pulp may also be or comprise a recycled fibre pulp, i.e. a pulp that is obtained from a fibre material which has previously been incorporated in a paper or board product. It is preferred that the recycled fibre pulp is obtained from, e.g., old corrugated containers or from clippings from corrugated box manufacturing, such as from material of EN 643, European List of Standard Grades of Paper and Board for Recycling, grades 1.02, 1.05 or 4.01. The bulk of the papermaking pulp may be bleached or unbleached. The bulk of the papermaking pulp may thus be a mixture of pulps from different sources, such as a mixture of a kraft pulp and a recycled fibre pulp. It is preferred that the bulk of the papermaking pulp is a mixture of an unbleached softwood kraft pulp and a recycled fibre pulp, or is a bleached hardwood kraft pulp.

The cellulosic fibre pulp is used as a component of a papermaking pulp, i.e. it is used in papermaking pulp in order to modify the properties of paper or board manufactured from the papermaking pulp. The use of the cellulosic fibre pulp as a component of the papermaking pulp may thus imply that fibre originating from the cellulosic fibre pulp corresponds, determined on a dry matter basis, to less than half of the fibre composition of the papermaking pulp and/or the paper or board manufactured from the papermaking pulp.

It has been unexpectedly found that use of cellulosic fibre pulp having a Schopper-Riegler number of about 70 or more as an additive to papermaking pulp enhances the compressive strength of paper or board manufactured from the papermaking pulp. The compressive strength may be expressed as the maximum compressive force per unit width that a test piece of paper or board can withstand until the onset of failure. The compressive strength is a relevant property of papers and boards used in the manufacture of packaging materials for containers and boxes. A box formed from a packaging material comprising paper or board having a high compressive strength withstands buckling, fold and/or collapse under the load of other boxes or goods stacked on top of it better than a box formed from a packaging material comprising paper or board having a lower compressive strength.

Compressive strength of a paper or board may be determined by the standardised short-span test according to ISO 9895. The result of such a short-span compressive strength test (SCT) may be reported as the short-span compressive index (SCT index), i.e. the compressive strength divided by the grammage. Compressive strength may be determined in the cross direction or the machine direction of the paper or board. For the purposes of this application, it is preferred to determine the compressive strength in the cross direction of the paper or board. Thus, the inventive use may more specifically relate enhancement of the short-span compressive index (SCT index), preferably in the cross direction (SCT CD index). Considering a conventional design of a container or box formed from a packaging material comprising paper or board, a vertical compressive force originating from a load on top of said box or container will act in the cross direction of the paper or board The paper or board manufactured from the papermaking pulp may be a paper or board that is suitable as a packaging material and/or for inclusion in a packaging material. The paper or board may thus be suitable as a single ply packaging material and/or as one or more of the plies of a multi ply packaging material. The paper or board may typically be an outer ply, an underliner, a middle and/or a core of a multi ply product, or a liner and/or a fluting of a corrugated fibreboard. It is preferred that the paper or board is a liner, such as a kraft liner or a test liner (recycled based liner).

The Schopper-Riegler number of the cellulosic fibre pulp may be about 70-90, preferably about 70-79, more preferably about 70-76.

The papermaking pulp may comprise at least one pulp component having a Schopper-Riegler number according to ISO 5267-1 of about 50 or less, preferably about 10-50. Alternatively, the papermaking pulp may comprise at least one pulp component having a Schopper-Riegler number of about 35 or less, preferably about 15-35, or of about 50 or less, preferably about 20-50. A softwood component of the papermaking pulp may typically have a Schopper-Riegler number of about 35 or less, preferably about 15-35. A recycled component of the papermaking pulp may typically have a Schopper-Riegler number of 50 or less, preferably about 20-50.

The cellulosic fibre pulp may be used as a component of the papermaking pulp in such amount that fibre originating from the cellulosic fibre pulp constitutes up to about 25 wt %, preferably about 1-25 wt %, more preferably about 5-25 wt %, determined on a dry matter basis, of the fibre composition of the papermaking pulp and/or of the paper or board manufactured, i.e. of the different types of fibres in the papermaking pulp or in the paper or board, respectively.

A filler, preferably a mineral filler, such as calcium carbonate or a clay, may be added to the papermaking pulp, preferably so that it constitutes up to about 25 wt %, determined on a dry matter basis, of the papermaking pulp and/or of the paper or board manufactured. Typically, such filler may be added to bleached papermaking pulp, such as a bleached hardwood papermaking pulp. The filler may contribute to the opacity and brightness of the paper or board manufactured from the papermaking pulp. The paper or board manufactured from a papermaking pulp to which a filler has been added is preferably a white liner.

The cellulosic fibre pulp may be prepared by beating or refining of a woodpulp or recycled fibre pulp to obtain the Schopper-Riegler number of the cellulosic fibre pulp.

The papermaking pulp may comprise a first portion of a woodpulp or recycled fibre pulp, and the cellulosic fibre pulp may be prepared from a second portion of the woodpulp or recycled fibre pulp. The objects of the invention may thus be obtained with a limited number of pulp raw materials.

At least a portion of the papermaking pulp may be prepared by diverting a portion of a stream of a woodpulp or recycled fibre pulp, beating or refining the diverted portion to obtain the Schopper-Riegler number of the cellulosic fibre pulp, and combining the beaten or refined portion with the stream of a woodpulp or recycled fibre pulp. Such preparation allows for optimal control of the properties of the cellulosic fibre pulp independent from control of the properties of the papermaking pulp.

When discussing pulps used for preparation of the cellulosic fibre pulp, the terms "woodpulp" and "recycled fibre pulp" refer to a source of woodpulp or recycled fibre pulp, respectively, that may be further treated, typically further mechanically treated, to reach a Schopper-Riegler number of about 70 or more. The woodpulp used for preparing the cellulosic fibre pulp is a pulp that is obtained from wood, such as a softwood and/or hardwood pulp, i.e. a pulp that is manufactured from softwood and/or hardwood. The woodpulp may be a mechanical and/or chemical pulp, i.e. a pulp in which the fibres have been separated by mechanical and/or chemical means. Thus, the woodpulp may also be a chemimechanical pulp. The woodpulp may typically be a kraft pulp or a sulphate pulp, i.e. a pulp that is manufactured by cooking a cellulosic material with a solution comprising sodium hydroxide and sodium hydrogen sulphide as active components, such as a softwood and/or hardwood kraft pulp, or a bisulphite pulp, i.e. a pulp that is manufactured by cooking wood with a solution having a pH value of approximately 4 and containing hydrogen sulphite (bisulphite) ions. The woodpulp may be bleached or unbleached. The woodpulp is preferably a softwood kraft pulp or a hardwood kraft pulp, more preferably an unbleached softwood kraft pulp or a bleached hardwood kraft pulp. The recycled fibre pulp used for preparing the cellulosic fibre pulp is a pulp that is obtained from a fibre material which has previously been incorporated in a paper or board product. It is preferred that the recycled fibre pulp is obtained from, e.g., old corrugated containers or from clippings from corrugated box manufacturing, such as from material of EN 643, European List of Standard Grades of Paper and Board for Recycling, grades 1.02, 1.05 or 4.01.

The woodpulp or the recycled fibre pulp used for preparing the cellulosic fibre pulp may be mechanically treated to reach a Schopper-Riegler number of 70 or more. The woodpulp or the recycled fibre pulp may thus be beaten or refined in a beater or refiner. The woodpulp or recycled fibre pulp may beaten or refined by passing a beater or refiner once or repeatedly. Repeated beating or refining may thus be arranged by passing the pulp to be beaten or refined in a loop through a single beater or refiner.

It is preferred that the cellulosic fibre pulp maintains substantially the fibre size distribution of the beaten or refined pulp. It is, in other words, preferred that the beaten or refined pulp is not subject to a fibre fractionation operation. Thus, it is preferred that the beaten or refined pulp is not subject to an operation for separating fibres into groups according to size. It is noticeable that the enhancing effect on the compressive strength of using cellulosic fibre pulp having a Schopper-Riegler number of about 70 or more as an additive to papermaking pulp occurs with the native fibre size distribution of the beaten or refined pulp serving as the cellulosic fibre pulp. There is thus no need to separate, from the beaten or refined pulp, fibres of a certain size to serve as the cellulosic fibre pulp.

Paper or board may be manufactured from the papermaking pulp by steps that are conventional and well known in the art.

EXAMPLES

In the following examples, use of a cellulosic fibre pulp having a Schopper-Riegler number of about 70 or more is exemplified by the use of a highly refined cellulosic fibre pulp ("ORK", "ORE" or "ORR", as further laid out below.

Laboratory Examples

In laboratory examples 1, 2, 3 and 5 below, paper hand-sheets were prepared from pulp mixtures comprising as one of their components a highly refined cellulosic fibre pulp. Physical properties, in particular strength properties, of the hand-sheets were subsequently tested. The laboratory examples were planned and evaluated using a mixture design with three mixture components, the proportions of the mixture components summing to 100%. The mixture design enabled prediction of responses, i.e. paper properties, for other combinations of the pulp mixture components than for the tested mixtures, and facilitated up-scaling to mill trials. A mixture design provides an estimate of how well the components can model a certain response. The most basic approach is to create a model by linearly fitting coefficients ("coeff") to the proportion of each mixture component ("comp").

$$\text{Response}=\text{Coeff1}*\text{Comp1}+\text{Coeff2}*\text{Comp2}+\text{Coeff3}*\text{Comp3}$$

When possible, responses for the tested mixtures were additionally evaluated by direct comparison.

The highly refined cellulosic fibre component was obtained by refining of a pulp as defined below to achieve a desired Schopper-Riegler number. Refining was performed with an Escher Wyss conical lab refiner run at a constant edge load of 1.5 J/m and a constant power of 1.05 kW. The desired refining energy was accomplished by recirculation of a pulp batch of around 0.5 kg.

A pulp mixture for hand-sheet preparation was obtained by mixing of pulp components as defined below and subsequent dilution with tap water to a pulp consistency of 0.2%. To the pulp mixture was added 1% of a cationic starch as a retention aid. Paper hand-sheets were produced from the pulp mixture in a Formette Dynamique sheet former at a drum speed of 1200 rpm. The formation took place at a pressure of 2.8 bar, with a ¼ MEG 2510TC nozzle having a 25° spray angle, and at a jet-to-drum angle of 35° against the cover plate tangent. The hand-sheets formed were passed three times through a roll press, at a pressure of 3, 6 and 6 bar, respectively. Drying of the pressed hand-sheets was performed by restrained drying in an L&W Rapid Dryer type 3-1. The drying time amounted to 14 minutes.

The following methods were used for testing of pulp.

Drainability (Schopper-Riegler number, SR): ISO 5267-1

Fibre length (Lorentzen/Wettre Fiber Tester Plus): ISO 16065-2

The following methods were used for testing of paper hand-sheets.

Grammage: ISO 536

Compressive strength—Short-span test (SCT): ISO 9895

Ash 525° C.: ISO 1762

Experimental results presented herein are average values of several measurements. Unless otherwise stated, the grammage is provided in g/m$^2$, the SCT CD (SCT cross direction) is provided in kN/m, and the SCT CD index (SCT cross direction index) is provided in kNm/kg. Herein, response models fitted to SCT CD index are based on averages of several measurements.

Unless otherwise stated, proportions of pulp mixture components given in % refer to weight % of the respective pulp component calculated as dry pulp.

Example 1

Laboratory Example

This example is based on a three component mixture design, the components being kraft pulp ("kraft"), recycled fibre pulp ("RCF") and highly refined kraft pulp ("ORK").

The kraft pulp was a softwood pulp drawn from a paper mill at a Schopper-Riegler number of 13 (day average value) and a Kappa number of 85.7. The average fibre length was 2.298 mm.

The recycled fibre pulp was drawn from a paper mill at a Schopper-Riegler number of 46 (calculated from a modified Schopper-Riegler number obtained with a larger orifice than prescribed by ISO 5267-1). The ash content (as tested on hand-sheets made from the recycled fibre pulp) was 9 wt %. The average fibre length was 1.275 mm.

The highly refined kraft pulp was prepared by refining, as described above, the kraft pulp to a Schopper-Riegler number of 77.5 using a specific refining energy of 600 kWh/ton. The fibre length was not measured.

The mixing plan, setting out the relative proportions (wt %) of the components, and the results are shown in table 1. A highly refined kraft pulp is hard to dewater and may not be used without mixing with other pulps. Hence the maximum dosage was set to 20%.

TABLE 1

Mixing plan and results

| Kraft | RCF | ORK | SCT CT | Grammage | SCT CD index |
|---|---|---|---|---|---|
| 100 | 0 | 0 | 0.84 | 103.9 | 8.1 |
| 90 | 0 | 10 | 1.13 | 102.2 | 11.1 |
| 80 | 0 | 20 | 1.36 | 104.2 | 13.1 |
| 40 | 40 | 20 | 1.75 | 97.6 | 17.9 |
| 45 | 45 | 10 | 1.51 | 99.8 | 15.1 |
| 50 | 50 | 0 | 1.26 | 100 | 12.6 |
| 0 | 80 | 20 | 2.04 | 98.4 | 20.7 |

TABLE 1-continued

Mixing plan and results

| Kraft | RCF | ORK | SCT CT | Grammage | SCT CD index |
|---|---|---|---|---|---|
| 0 | 90 | 10 | 1.82 | 98.9 | 18.4 |
| 0 | 100 | 0 | 1.55 | 98 | 15.8 |

Table 2 shows a statistical evaluation of the results, by which a model, as set out above, was created for SCT CD index. Neither the model nor the components have any risk for non-significance, according to the statistical tests performed as part of the evaluation (F and t tests with 95% confidence limits).

TABLE 2

Statistical evaluation of SCT CD index

| Model | |
|---|---|
| Adjusted $R^2$ | 0.80 |
| Risk for no significance (F test) | 0.000 |
| Coefficient (importance) | |
| Kraft | 0.080 |
| RCF | 0.164 |
| ORK | 0.377 |
| Coeff. Risk for no significance (t test) | |
| Kraft | 3.86E−05 |
| RCF | 2.28E−07 |
| ORK | 2.51E−05 |

Table 2 shows that ORK is by far the most important component for SCT CD index (coefficient 0.337). It is apparent that kraft pulp having a Schopper-Riegler number of 13 has a poor SCT strength and is not suited for paper making without additional refining, as its coefficient is lower than the coefficient for RCF. This manifests itself such that recycled fibre pulp contributes twice as much to the SCT CD index as the kraft pulp.

For strength comparisons, predicted results for two hypothetical mixtures with different amounts of kraft pulp, with and without highly refined pulp are shown in table 3. Experimental results for the same mixtures are shown in table 4.

TABLE 3

Predicted results for hypothetical mixtures

| Mixture | |
|---|---|
| Kraft | 100 |
| RCF | 0 |
| ORK | 0 |
| | SCT CD index |
| | 8.04 |
| Kraft | 90 |
| RCF | 0 |
| ORK | 10 |
| | SCT CD index |
| Model | 11.0 |
| Change (improvement with 10% ORK) | 36.8% |

TABLE 4

| Experimental results | |
|---|---|
| Mixture | |
| Kraft | 100 |
| RCF | 0 |
| ORK | 0 |
| | SCT CD index |
| Experiment | 8.08 |
| Kraft | 90 |
| RCF | 0 |
| ORK | 10 |
| | SCT CD index |
| Experiment | 11.1 |
| Change (improvement with 10% ORK) | 37.4% |

It is to be noted that the experimental results originates from the same population as was used for building the model.

Example 2

Laboratory Example

This example is based on a three component mixture design, the components being refined kraft pulp ("kraft"), recycled fibre pulp ("RCF") and highly refined kraft pulp ("ORK").

The refined kraft pulp was prepared by refining, as described above, a softwood kraft pulp drawn from a paper mill at a Schopper-Riegler number of 13 (day average value) to a Schopper Riegler number of 20 using a specific refining energy of 100 kWh/ton. The average fibre length after refining was 2.242 mm.

The recycled fibre pulp was drawn from the same mill. Its Schopper-Riegler number was not measured. The ash content (as tested on hand-sheets made from the recycled fibre pulp) was 9.75 wt %. The average fibre length was 1.20 mm.

The highly refined kraft pulp was prepared by refining, as described above, a softwood kraft pulp drawn from a paper mill at a Schopper-Riegler number of 13 (day average value) to a Schopper Riegler number of 76 using a specific refining energy of 450 kWh/ton. The average fibre length after refining was 1.831 mm.

The mixing plan, setting out the relative proportions (wt %) of the components, and the results are shown in table 5. A highly refined kraft is hard to dewater and may not be used without mixing with other pulps. Hence maximum dosage is set to 20%.

TABLE 5

Mixing plan and results

| Kraft | RCF | ORK | SCT CD | Grammage | SCT CD index |
|---|---|---|---|---|---|
| 100 | 0 | 0 | 1.62 | 106.2 | 15.25 |
| 90 | 0 | 10 | 1.74 | 103.8 | 16.76 |
| 80 | 0 | 20 | 2.01 | 103.3 | 19.46 |
| 50 | 50 | 0 | 1.51 | 101.5 | 14.88 |
| 45 | 45 | 10 | 1.66 | 101 | 16.44 |
| 40 | 40 | 20 | 1.84 | 100.8 | 18.25 |
| 0 | 80 | 20 | 1.78 | 99 | 17.98 |
| 0 | 90 | 10 | 1.58 | 98.9 | 15.98 |
| 0 | 100 | 0 | 1.38 | 97.7 | 14.12 |

Table 6 shows a statistical evaluation of the results, by which a model, as set out above, was created for SCT CD index. Neither the model nor the components have any risk for non-significance according to the statistical tests performed as part of the evaluation (F and t tests with 95% confidence limits).

TABLE 6

Statistical evaluation of SCT CD index

| Model | |
|---|---|
| Adjusted $R^2$ | 0.83 |
| Risk for no significance (F test) | 0.000 |
| Coefficient (importance) | |
| Kraft | 0.153 |
| RCF | 0.140 |
| ORK | 0.337 |
| Coeff. Risk for no significance (t test) | |
| Kraft | 3.24E−10 |
| RCF | 5.36E−10 |
| ORK | 6.23E−08 |

ORK is the superior pulp component in contributing to a high SCT CD index, as shown by the high coefficient in table 6 (0.337). The kraft component has gained strength potential with refining (having a Schopper-Riegler number of 20), and is slightly better than RCF in contributing to SCT CD index, as compared to the kraft component of laboratory example 1 (having a Schopper-Riegler number of 13).

For strength comparisons, predicted results for hypothetical mixtures of respectively pure kraft and a 90/10% kraft/ORK mixture are shown in table 7. A 12% improvement of SCT CD index is shown. Experimental results for the same mixtures are shown in table 8.

TABLE 7

Predicted results for hypothetical mixtures

| Mixture | |
|---|---|
| Kraft | 100 |
| RCF | 0 |
| ORK | 0 |
| | SCT CD index |
| Model | 15.3 |
| Kraft | 90 |
| RCF | 0 |
| ORK | 10 |
| | SCT CD index |
| Model | 17.1 |
| Change | 12% |

TABLE 8

Experimental results

| Mixture | |
|---|---|
| Kraft | 100 |
| RCF | 0 |
| ORK | 0 |
| | SCT CD index |
| Experiment | 15.25 |
| Kraft | 90 |
| RCF | 0 |
| ORK | 10 |
| | SCT CD index |
| Experiment | 16.8 |
| Change | 10% |

It is again to be noted that the same population was used for experimental results and for building the model.

Example 3

Laboratory Example

This example is based on a three component mixture design, the components being bleached eucalyptus (hardwood) kraft pulp ("kraft"), filler and highly refined bleached eucalyptus (hardwood) kraft pulp ("ORE").

The bleached eucalyptus kraft pulp was prepared by refining, as described above, a dry market pulp obtained from Suzano at a Schopper-Riegler number of 17.5 to a Schopper-Riegler number of 30. The average fibre length after refining was 0.741 mm.

The filler was $CaCO_3$ (Hydrocarb 60-ME obtained from Omya).

The highly refined bleached eucalyptus kraft pulp was prepared by refining, as described above, a dry market pulp obtained from Suzano at a Schopper-Riegler number of 17.5 to a Schopper-Riegler number of 75. The average fibre length after refining was 0.688 mm The mixing plan, setting out the relative proportions (wt %) of the components, and the results are shown in table 9. As a filler does generally not contribute to strength, the maximum dosage is set to 12%. For the same reason as in laboratory examples 1 and 2, the maximum dosage of ORE is set to 20%.

TABLE 9

Mixing plan and results

| Kraft | ORE | Filler | Grammage | SCT CD | SCT CD index |
|---|---|---|---|---|---|
| 88 | 0 | 12 | 69.5 | 1.3 | 18.7 |
| 78.8 | 9.2 | 12 | 69.4 | 1.42 | 20.5 |
| 70.1 | 17.9 | 12 | 70.1 | 1.49 | 21.3 |
| 94 | 0 | 6 | 69.9 | 1.42 | 20.3 |
| 84.2 | 9.8 | 6 | 68.6 | 1.47 | 21.4 |
| 74.9 | 19.1 | 6 | 69.8 | 1.59 | 22.8 |
| 100 | 0 | 0 | 70.9 | 1.49 | 21 |
| 89.6 | 10.4 | 0 | 70.4 | 1.59 | 22.6 |
| 79.7 | 20.3 | 0 | 69.9 | 1.66 | 23.7 |

Table 10 shows a statistical evaluation of the results, by which a model, as set out above, was created for SCT CD index. The significance test of filler influence on SCT CD index barely makes it below the 5% limit. Values lower than 5% can be regarded as significant.

TABLE 10

Statistical evaluation of SCT CD index

| Model | |
|---|---|
| Adjusted $R^2$ | 0.83 |
| Risk for no significance (F test) | 0.000 |
| Coefficient (importance) | |
| Kraft | 0.211 |
| Filler | 0.036 |
| ORE | 0.347 |
| Coeff. Risk for no significance (t test) | |
| Kraft | 0.000 |
| Filler | 0.049 |
| ORE | 0.000 |

As can be seen in table 10, ORE is the component contributing the most to SCT CD index (0.347). Also the kraft component contributes to SCT CD index. The filler has a very small influence on SCT CD index.

Utilising hypothetic mixtures of respectively pure kraft and a kraft/ORE mixture of 90/10%, no filler, predicted results are shown in table 11. Strength improvement amounts to about 6.5% increase for SCT CD index. Experimental results for the same mixtures are shown in table 12.

TABLE 11

Predicted results for hypothetical mixtures

| Mixture | |
|---|---|
| Kraft | 100 |
| RCF | 0 |
| ORE | 0 |
| | SCT CD index |
| Model | 21.1 |
| Kraft | 90 |
| RCF | 0 |
| ORE | 10 |
| | SCT CD index |
| Model | 22.5 |
| Change | 6.4% |

TABLE 12

Experimental results

| Mixture | |
|---|---|
| Kraft | 100 |
| RCF | 0 |
| ORE | 0 |
| | SCT CD index |
| Experiment | 21.00 |
| Kraft | 90 |
| RCF | 0 |
| ORE | 10 |
| | SCT CD index |
| Experiment | 22.6 |
| Change | 7.62% |

It is again to be noted that the same population was used for experimental results and for building the model.

Example 4

Factory Example

Full scale production of two-ply kraftliner was performed at Smurfit Kappa's facilities (PM6) in Facture, France. A trial two-ply kraftliner in which the bottom ply was produced from a pulp composition of 50 wt % of an ordinary kraft softwood pulp, 30 wt % of a recycled fibre pulp and 20 wt % of a highly refined softwood pulp ("ORK") was compared to a control two-ply kraftliner in which the bottom ply was produced from a pulp composition of 75 wt % of the ordinary kraft softwood pulp and 25 wt % of the recycled fibre pulp. The ordinary kraft softwood pulp had been brought to a Schopper-Riegler number of 16-20 by passing it through an ordinary refiner for bottom ply pulp. The highly refined softwood pulp for the trial kraftliner had been prepared by passing an amount of the ordinary kraft softwood pulp in a loop through an ordinary refiner for bottom ply pulp until a Schopper-Riegler number of 75 was reached. For the trial kraftliner the top layer constituted 30% of the total kraftliner, whereas for the control craftliner the top layer constituted 20% of the total kraftliner.

The trial kraftliner was found to have a SCT CD index of 19.3 whereas the control kraftliner had a SCT CD index of 18.0 (both values being average values of several measurements), indicating an increase by 7%.

Example 5

Laboratory Example

This example is based on a three component mixture design, the components being refined kraft pulp ("kraft"), recycled fibre pulp ("RCF") and highly refined recycled pulp ("ORR").

The refined kraft pulp was a softwood kraft pulp drawn from a paper mill at a Schopper-Riegler number of 15. The average fibre length was 2.246 mm and the ash content was 0.9 wt %.

The recycled fibre pulp was drawn from a paper mill at a Schopper-Riegler number of 32. The ash content (as tested on hand-sheets made from the recycled fibre pulp) was 9.7 wt %. The average fibre length was 1.298 mm.

The highly refined recycled pulp was prepared by refining, as described above, the recycled fibre pulp to a Schopper Riegler number of 74 using a specific refining energy of 215 kWh/ton. The average fibre length after refining was 1.084 mm.

The mixing plan, setting out the relative proportions (wt %) of the components, and the results are shown in table 13. A highly refined recycled pulp is hard to dewater and may not be used without mixing with other pulps. Hence maximum dosage is set to 20%.

TABLE 13

Mixing plan and results

| Kraft | RCF | ORR | SCT CD | Grammage | SCT CD index |
|---|---|---|---|---|---|
| 100 | 0 | 0 | 1.9 | 104.4 | 18.2 |
| 90 | 0 | 10 | 2.02 | 101.8 | 19.8 |
| 80 | 0 | 20 | 2 | 100.2 | 20 |
| 50 | 50 | 0 | 1.75 | 102.5 | 17.1 |
| 45 | 45 | 10 | 1.79 | 102.1 | 17.5 |
| 40 | 40 | 20 | 1.95 | 101.3 | 19.2 |
| 0 | 80 | 20 | 1.76 | 100.8 | 17.5 |
| 0 | 90 | 10 | 1.67 | 100 | 16.7 |
| 0 | 100 | 0 | 1.64 | 104.3 | 15.7 |

Table 14 shows a statistical evaluation of the results, by which a model, as set out above, was created for SCT CD index. Neither the model nor the components have any risk for non-significance according to the statistical tests performed as part of the evaluation (F and t tests with 95% confidence limits).

TABLE 14

Statistical evaluation of SCT CD index

| Model | |
|---|---|
| Adjusted $R^2$ | 0.83 |
| Risk for no significance (F test) | 0.000 |
| Coefficient (importance) | |
| Kraft | 0.185 |
| RCF | 0.155 |
| ORR | 0.265 |

TABLE 14-continued

Statistical evaluation of SCT CD index

| Coeff. Risk for no significance (t test) | |
|---|---|
| Kraft | 3.51E−10 |
| RCF | 1.00E−09 |
| ORR | 8.82E−07 |

ORR is the superior pulp component for SCT CD index as shown by the high coefficient (0.265) in table 14.

For strength comparisons, predicted results for hypothetical mixtures of respectively pure kraft and a 90/10% kraft/ORR mixture are shown in table 15. A 4.3% improvement of SCT CD index is shown. Experimental results for the same mixtures are shown in table 16.

TABLE 15

Predicted results for hypothetical mixtures

| Mixture | |
|---|---|
| Kraft | 100 |
| RCF | 0 |
| ORR | 0 |
| | SCT CD index |
| Model | 18.5 |
| Kraft | 90 |
| RCF | 0 |
| ORR | 10 |
| | SCT CD index |
| Model | 19.3 |
| Change | 4.3% |

TABLE 16

Experimental results

| Mixture | |
|---|---|
| Kraft | 100 |
| RCF | 0 |
| ORR | 0 |
| | SCT CD index |
| Experiment | 18.2 |
| Kraft | 90 |
| RCF | 0 |
| ORR | 10 |
| | SCT CD index |
| Experiment | 19.3 |
| Change | 8.79% |

It is again to be noted that the same population was used for experimental results and for building the model.

Example 6

Possible Industrial Application

The exemplary mixtures of table 17 are proposed for industrial application in the manufacture of paper or board having a high compressive strength. Kraft=kraft pulp, RCF=recycled fibre pulp, ORR=highly refined recycled fibre pulp (Schopper-Riegler number ≤70), ORK=highly refined kraft pulp (Schopper-Riegler number ≤70).

TABLE 17

| Exemplary mixtures (wt % on a dry matter basis) | | | | | |
|---|---|---|---|---|---|
| | Kraft | | | | |
| | 60 | 50 | 50 | 70 | 70 |
| RCF | 30 | 30 | 30 | 20 | 10 |
| ORR | 10 | 20 | 0 | 10 | 20 |
| ORK | 0 | 0 | 20 | 0 | 0 |

DISCUSSION

The laboratory and factory examples laid out above confirm that addition of an extensively refined cellulosic fibre pulp to a papermaking pulp enhances the compressive strength, in particular the SCT CD, of paper or board manufactured from the papermaking pulp. An extensively refined cellulosic fibre pulp may thus be used to allow higher recycled content as well as higher filler content in a papermaking pulp.

The invention claimed is:

1. A process for manufacturing paper or board, comprising:

preparing a cellulosic fibre pulp by beating or refining a woodpulp or recycled fibre pulp to obtain a Schopper-Riegler number according to ISO 5267-1 of 70 or more;

using the cellulosic fibre pulp having a Schopper-Riegler number according to ISO 5267-1 of about 70 or more as a component of a papermaking pulp, wherein the cellulosic fibre pulp is used in the papermaking pulp in such amount that fibre originating from the cellulosic fibre pulp constitutes up to about 25 wt %, determined on a dry matter basis, of the fibre composition of the papermaking pulp and/or of the paper or board to be manufactured; and manufacturing paper or board from the papermaking pulp.

2. The process according to claim 1, wherein the Schopper-Riegler number of the cellulosic fibre pulp is about 70-79.

3. The process according to claim 1, wherein a filler is added to the papermaking pulp.

* * * * *